US008333263B1

(12) United States Patent
Wright

(10) Patent No.: US 8,333,263 B1
(45) Date of Patent: Dec. 18, 2012

(54) FRONT-END CARRIER FOR TRACTOR

(76) Inventor: William Edward Wright, Carbondale, IL (US)

( * ) Notice: Subject to any disclaimer, the term of this patent is extended or adjusted under 35 U.S.C. 154(b) by 179 days.

(21) Appl. No.: 12/853,355

(22) Filed: Aug. 10, 2010

(51) Int. Cl.
*E04G 1/18* (2006.01)

(52) U.S. Cl. ..... 182/148

(58) Field of Classification Search ..... 182/63.1, 182/148, 113, 222; 108/51.11, 57.21; 414/607, 414/723, 724, 722; 37/403, 407, 266, 268; 172/817, 684.5; 187/237
See application file for complete search history.

(56) References Cited

U.S. PATENT DOCUMENTS 2,699,878 A * 1/1955 Avery ..... 254/386
3,379,281 A * 4/1968 Calletti et al. ..... 182/113
4,992,020 A * 2/1991 Bartlett ..... 414/723
5,064,338 A * 11/1991 Lawrence ..... 414/685
5,555,953 A * 9/1996 Henderson ..... 182/141
2007/0261917 A1* 11/2007 Webster ..... 182/148

* cited by examiner

*Primary Examiner* — James O Hansen
*Assistant Examiner* — Kristine Florio
(74) *Attorney, Agent, or Firm* — Adam K. Sacharoff

(57) ABSTRACT

This implement attaches to the hydraulic system of a front-end loader for a tractor or similar vehicle. It has two planar surfaces, a deck and a back, that are fastened together at an approximately 90 degree angle. The deck is constructed primarily of wooden or synthetic boards or sheets, supported below or above by two or more steel angle irons or channel irons bolted to the boards or sheets. The back consists of a similar combination of boards or sheets, irons, and bolts, with a grill or strips possibly replacing some boards or sheets in the upper part. Each deck support is fastened to a back support using one or two steel braces or gussets, bolted or welded to the supports. Two steel yokes are fastened to the back, suitable for attaching the carrier to the front-end loader hydraulics. The carrier can be lifted and tilted by the front-end loader system, just as the system would do with its normal bucket attachment.

7 Claims, 14 Drawing Sheets

FRONT-END CARRIER FOR TRACTOR

BACKGROUND OF THE INVENTION

The attachment used most commonly on tractor front-end loaders is a bucket made of steel, having a bottom (or "floor"), a back, two sides, a short top near the back, and one or two components, which we call yokes, welded to the back, for connecting the attachment to the front-end loader hydraulics. The bucket is small enough and strong enough so that it is highly suitable for loading material such as dirt, sand, and gravel by driving the tractor forward to push the bucket into a pile of such material. The bucket is also capable of digging down into the ground a short distance and scooping up dirt. The bucket can be lifted and tilted by the hydraulic system, and in particular can be tilted downward so as to unload the bucket by spilling the material out of it.

A disadvantage of the bucket is that its volume and floor area are too small for many applications that do not require scooping but do require carrying or lifting a large volume or large area of objects or materials. Typical dimensions for a wide range of tractors are a width of five or six feet and a depth and height of about two feet or less, giving a volume of 24 cubic feet or less and an area of 12 square feet or less. The side walls give the bucket strength and rigidity but inhibit its use for carrying objects longer than the bucket width.

Another attachment available for tractor front-end loaders is a fork lift, which might be attached to the front of the bucket or directly to the hydraulics. This device permits lifting material placed on pallets, and also carrying long objects that rest on the forks. A disadvantage is that the attachment is not suitable for lifting or carrying many objects that are not on a pallet and are not long enough or stiff enough to lay across the forks, such as sticks and short log segments, tools, fencing, nursery stock, roofing materials, masonry, firewood, fertilizer and seed bags, straw bales, and many more.

A third type of attachment for tractor front-end loaders is a hay fork, designed for lifting and carrying large round or square hay bales. It clearly has the disadvantages described in the preceding paragraph for the fork lift.

Yet another attachment (U.S. Pat. No. 4,992,020) has a solid bottom and back, without sides, that make it suitable for carrying both long objects that extend beyond the sides, and also small objects or material that are placed on a portion of the bottom surface. The bottom of the attachment includes two plates fastened together at a small angle to form a wedge or thin triangular shape when viewed from the side. These plates are separated and held in position by several triangular supporting plates as well as several other reinforcing plates. The back of the attachment consists of an I-beam and two yokes. The physical embodiment of this device comprises steel plates welded together. The manufacturing process would be quite sophisticated, as the individual components would require extensive cutting and welding. The volume of the device, for stacking material such as brush, would be relatively small unless the I-beam back were high (e.g., 3 or 4 feet) and wide (e.g., 8 feet or more), in which case the weight and material cost would also be very high. No tests of the strength or capacity of the attachment were provided, and it is not clear that this design is particularly strong relative to its complexity, weight, and cost. In general, the very high most of materials and the extremely high cost of cutting and welding the steel components, in order to fabricate the implement, make this design highly inefficient and impractical for the lifting and carrying functions that are the purpose of the front-end carrier.

The front-end carrier of the present invention permits multiple embodiments or aspects that provide several advantages over the devices just discussed, and may include any or all of the following advantages: First, the aspects have a relatively large capacity with respect to both volume and area. This capacity is roughly similar to that of the bed of a full-size pickup truck. Second, the aspects can carry many small objects lying on the deck. Third, the aspects can conveniently carry objects that are longer than the width of the aspect. Fourth, the aspects can be made relatively cheaply, largely from common, off-the-shelf materials with simple fabrication techniques. Fifth, the aspects can be used as a scaffold, with a large area for standing, moving around, storing tools and material, etc. Sixth, the aspects can be marketed in a few different states of assembly, making shipping more economical. These and other advantages of one or more aspects of the carrier will be evident from the embodiments discussed below and will be discussed in more detail in a later section.

The embodiments of the invention attach to the hydraulic system of a tractor's (or similar vehicle's) front-end loader. Each embodiment has two planar surfaces, a deck and a back, that are fastened together at an approximately 90 degree angle using steel braces in the shape of a thick carpenter's square (with possibly equal legs). When the carrier is held in neutral position, the deck is horizontal and the back rises vertically from the back of the deck. One or two components, which we call yokes, are fastened to the back of the carrier for the purpose of connecting the carrier to the front-end loader hydraulics. The carrier can be lifted and tilted by the front-end loader system, just as the system would do with its normal bucket attachment.

The deck is constructed primarily of wooden or synthetic boards or sheets, fastened together and supported by two or more steel angle irons or channel irons bolted to the boards. The back consists of a similar combination of boards or sheets, iron supports, and bolts, with a grill or strips possibly replacing some boards in the upper region, to improve visibility for the driver on the tractor. Each deck support is rigidly fastened to a back support using one or two steel braces in the shape of a flat corner iron (or thick carpenter's square), bolted or welded to the supports.

The carrier typically has a much larger deck and back than a bucket attachment. For example, the design can easily support an embodiment that is 10 feet wide, 4 feet deep, and 4 feet high, and that can hold loads well in excess of a tractor's lifting capacity. Thus the device can carry material (e.g., brush, lumber, nursery stock, tools, roofing, bricks, fertilizer and seed bags, etc.) spread over a much larger area than a bucket. Also, unlike a bucket attachment, it has no sides, and can therefore carry objects that are longer than its width, such as logs, pipes, brush, lumber, etc. Finally, for carrying material such as brush, the carrier can be tilted backward, with the deck and back forming a "V" shape that permits piling the material quite high without it falling off. Experimental results have shown that, for this purpose, the carrier has as much capacity as a full-size pickup truck with the tailgate down and stacked as high as possible.

Using this implement on a tractor's front-end loader, for carrying various objects, has many advantages over a pickup truck and a trailer. The deck can be lowered to within a few inches of the ground, thus facilitating the loading of objects, especially heavy objects. For example, tree trunk sections of a few hundred pounds can be rolled onto the deck. The deck can be raised to the level of a trailer or truck bed to ease the movement of certain heavy objects onto or off of the carrier. Also, a tractor is much more maneuverable than a truck and especially a trailer, enabling the operator to get very close to the material to be loaded. And a tractor can move into muddy, soft, or weedy areas that might be inaccessible to a truck or trailer. Finally, for materials such as brush, the operation of unloading requires virtually no manual effort, thus providing a major advantage over trucks and trailers for brush collection.

LIST OF REFERENCE NUMBERS IN FIGURES

| | | | |
|---|---|---|---|
| 10 | Left deck support | 12 | Right deck support |
| 14 | Left back support | 16 | Right back support |
| 18 | L-brace | 20 | Left yoke |
| 22 | Right yoke | 24 | Left yoke plate |
| 26 | Right yoke plate | 30 | Deck board |
| 32 | Lower back board | 34 | Top back board |
| 36 | Deck side board | 38 | Back side board |
| 40 | Grill | 50 | Left deck support with gusset |
| 52 | Left back support using gusset | 54 | Gusset |
| 60 | Left deck support (alternative) | 62 | Left back support alternative) |
| 64 | Straight brace | 66 | Spacer |
| 70 | Rail board | 72 | Rail post |
| 74 | Flange | 80 | Deck stiffener |
| 82 | Tool box | 84 | Wrench holder |
| 86 | Tool hanger | 88 | Ear muff holder |
| 90 | Ramp | 92 | Ramp storage compartment |

Detailed Description

First Embodiment

Figure 1:
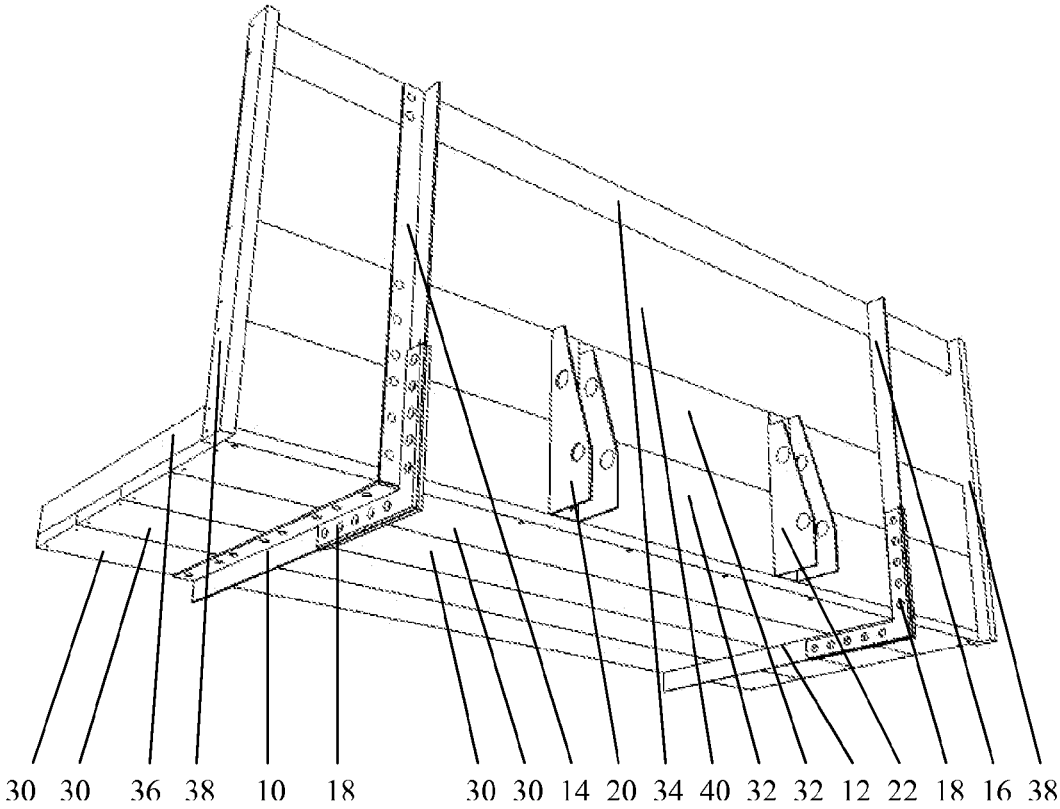
FIG. 1 is a perspective view of a first embodiment of the front-end carrier, as viewed from behind, below, and to the left of the carrier.
Figure 2:
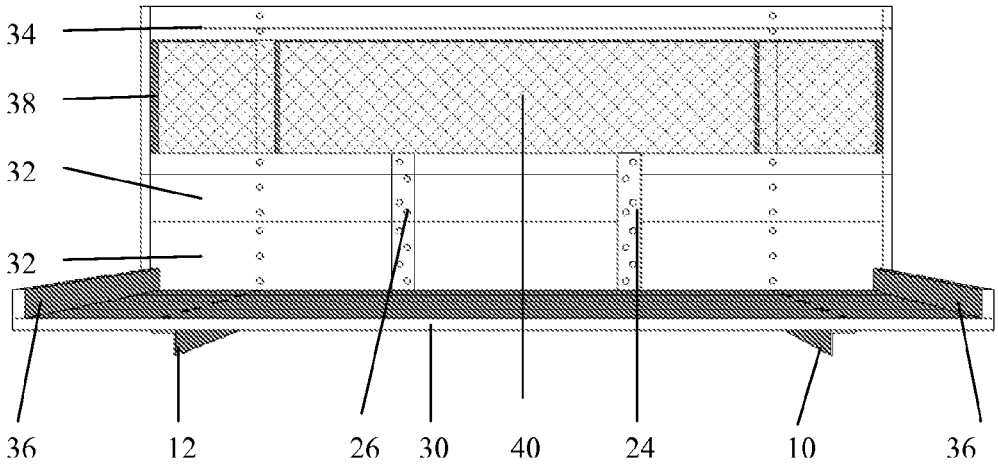
FIG. 2 is a perspective view of the carrier from the front.

FIG. 1 is a perspective view of a first embodiment of the front-end carrier, as seen from behind, below, and to the left of the carrier. FIG. 2 is a perspective view of the carrier from the front.

Parts 10 and 12 are the left and right deck supports, respectively. Parts 14 and 16 are the left and right back supports, respectively. Part 18 is an L-brace used to connect a deck support and back support, and hold them rigidly at a 90-degree angle. Three L-braces are shown in FIG. 1, but the brace on the right side of the right deck support and right back support is not visible in FIG. 1. Parts 20 and 22 are the left and right yokes, respectively, which can be connected to the hydraulic system of the tractor's front-end loader using four pins. The left and right yoke plates 24 and 26 are shown in FIG. 2.

This embodiment has four deck boards 30, two lower back boards 32, and one top back board 34. It has deck side boards 36 at the left and right ends of the deck (the right deck side board is not visible in FIG. 1 but is visible in FIG. 2), and back side boards 38 at the left and right ends of the back. Finally, the upper half of the back consists mostly of a grill 40.

Figure 3:
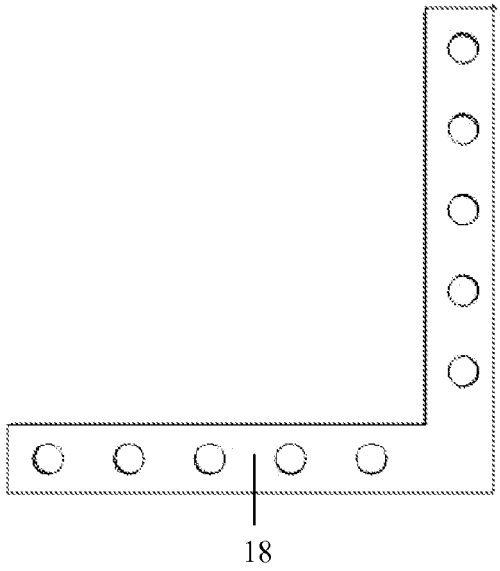
FIG. 3 shows a flat corner iron, which we call an L-brace.
Figure 4A:
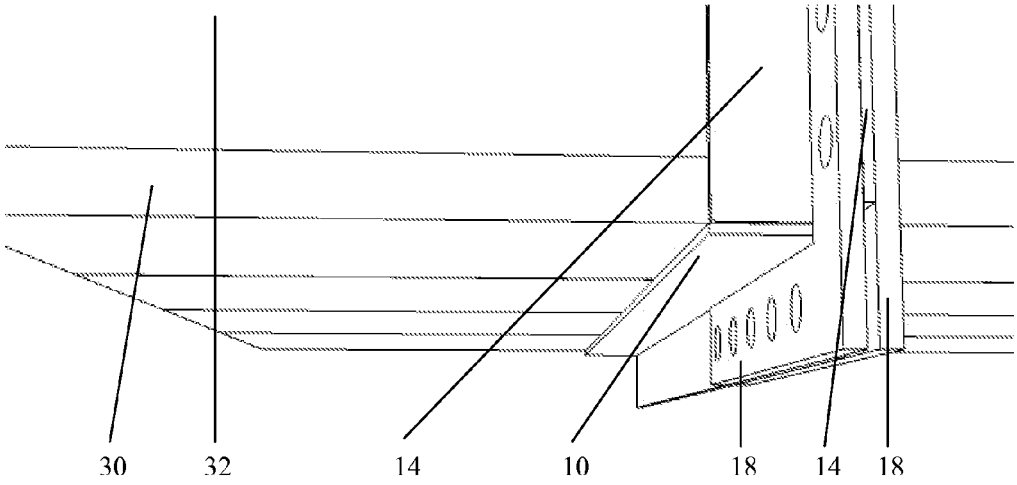
FIG. 4*a* is a close-up of the carrier from the back and slightly below.
Figure 4B:
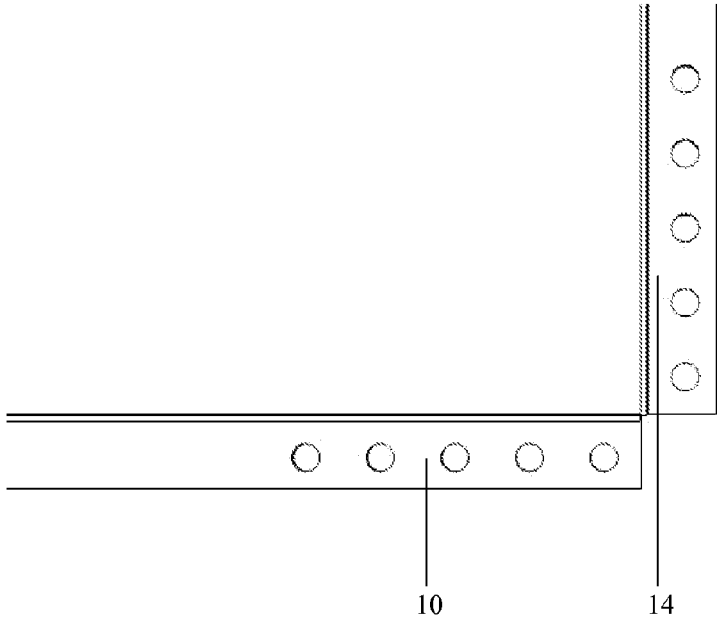
FIG. 4*b* shows the left deck support and left back support in relative position.
Figure 4C:
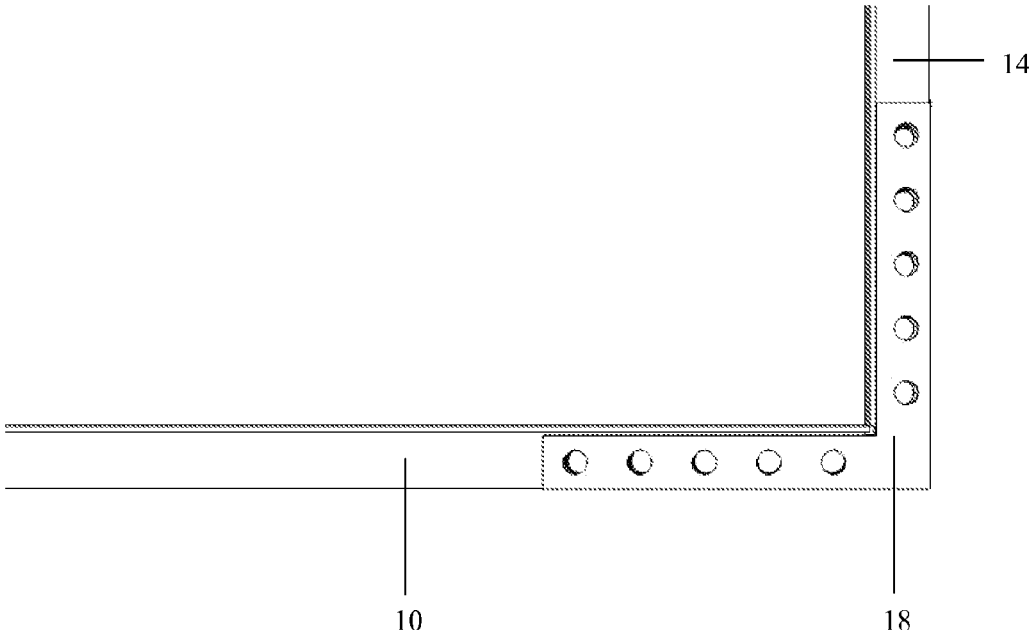
FIG. 4*c* shows the same supports with one brace attached.

FIG. 3 shows an L-brace alone. FIG. 4*a* is a close-up of the carrier from the back and slightly below, focusing on the left deck support 10, left back support 14, two L-braces 18, the back-most deck board 30, and the bottom back board 32. FIG. 4*b* shows the left deck support and left back support positioned exactly as if they were fastened to a brace, and FIG. 4*c* shows the same supports with one brace attached.

Figure 5:
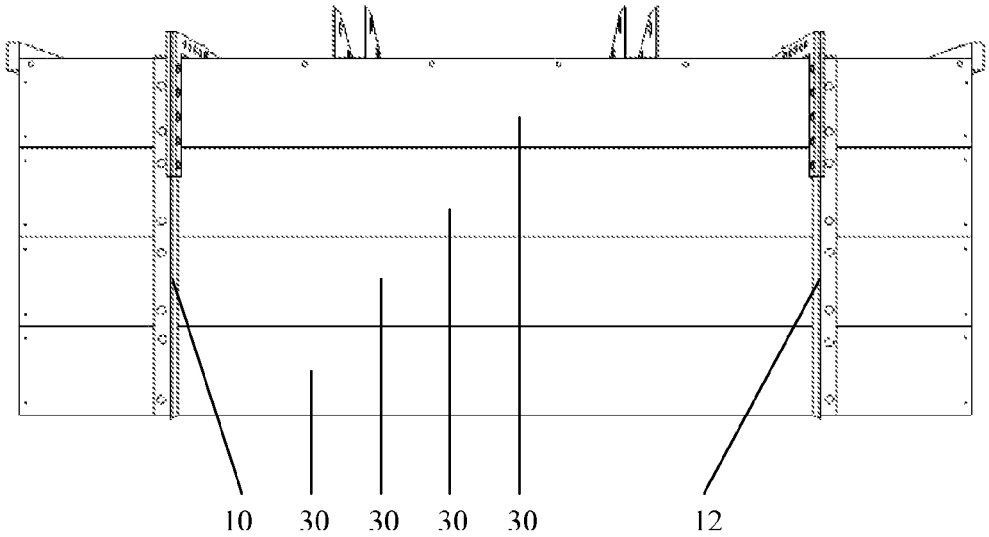
FIG. 5 is a perspective view of the carrier from below.
Figure 6:
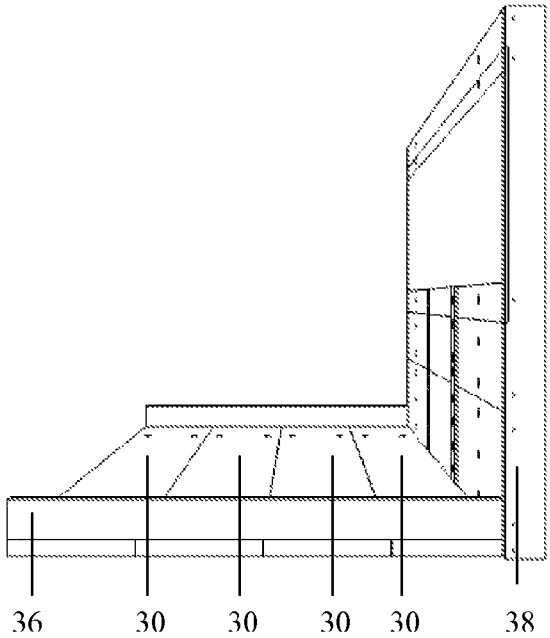
FIG. 6 is a view from the left of the carrier.
Figure 7A:
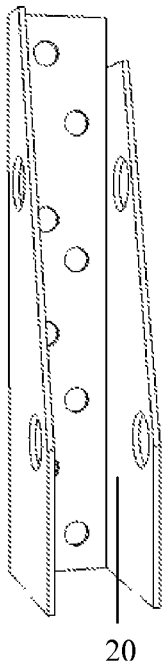
FIG. 7*a* is a view of the left yoke from behind and slightly to the left.
Figure 7B:
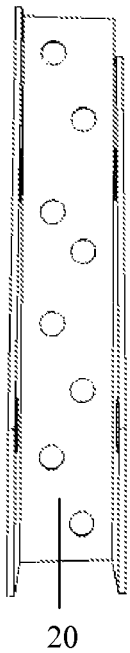
FIG. 7*b* is a view of the left yoke as seen straight from behind.
Figure 8A:
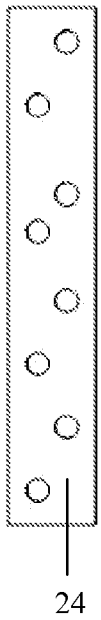
FIG. 8*a* shows the left yoke plate as seen near the front left corner of the carrier.
Figure 8B:
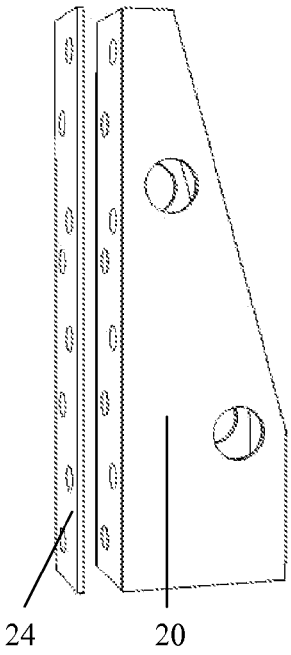
FIG. 8*b* shows the left yoke and left yoke plate in their proper relative position.

FIG. 5 is a perspective view of the carrier from below, and FIG. 6 is a view from the left of the carrier. FIG. 7*a* is a view of the left yoke 20 from behind and slightly to the left, and FIG. 7*b* is a view of the left yoke as seen straight from behind. FIG. 8*a* shows the left yoke plate 24 as seen near the front left corner of the carrier, and FIG. 8*b* shows the left yoke and left yoke plate together as seen from the left, in their proper relative position.

In this embodiment, the deck and back supports are ¼"×3"×3" angle irons. The deck supports 10 and 12 are 45" long, and the back supports 14 and 16 are 48" long. The L-braces 18 are made of two ½"×2½" steel bars welded together to form legs of length 18" from outside corner to end.

All boards in this embodiment are pressure treated boards. The deck boards 30 and lower back boards 32 are 2"×12"×10' boards, and the top back board 34 is 2"×6"×10'. The deck side boards 36 are 2"×4"×43¼", and the back side boards 38 are 2"×4"×48". The actual board dimensions are 1½"×11¼"×10', 1½"×5½"×10', 1½"×3½"×43½", and 1½"×3½"×48", respectively.

The grill 40 is 2 feet high and 10 feet wide, and is made of galvanized steel cut from a cattle panel, hog panel, field fence, or similar fencing.

The yokes 20 and 22 are each constructed from three 1/4" steel plates welded together. The back of the yoke is 4¼"×22½". The outer side of each yoke (i.e., the side farthest from the center of the carrier) is in the shape of a 22½"×6¾" rectangle with a right triangle with legs 4¾"×16½" cut from the upper outside corner. The inner side of each yoke has the shape of the outer side with 2" cut from the top to provide clearance for the hydraulic hose of the front-end loader. The reason for the difference in length of the top side of the yoke and the bottom side is explained below. The left and right yoke plates 24 and 26 are ⅛"×4"×22½" steel plates.

FIG. 4*a* illustrates how the left deck support 10, left back support 14, and two braces 18 are connected together and positioned underneath the deck boards 30 and behind the back boards 32. FIG. 4*b* shows the left deck support and left back support alone, positioned exactly as if they were fastened to a brace. FIG. 4*c* shows the same supports with one brace attached.

Each leg of each brace has five 9/16 inch holes punched or drilled in it, to match with five 9/16 inch holes in the side of the back end of a deck support, or five 9/16 inch holes in the side of the bottom end of a back support. The holes in the legs are centered 1¼" from each edge, and at distances 4½", 7½", 10½", 13½", and 16½" from the outside corner of the brace. The holes in the deck and back supports are centered 1¼" from the bottom edge (deck support) or the back edge (back support), at distances 1½", 4½", 7½", 10½", and 13½" from the end of the support. The supports and braces are fastened together using 10½"×2" hex head bolts, 10 nuts and lock washers, and 20 flat washers. (All fasteners (e.g., bolts, nuts, washers, screws, staples) used on the carrier are galvanized, and all of the supports, braces, yokes, and yoke plates are primed and painted.)

FIG. 5 shows the holes in the deck supports 10 and 12 through which bolts are passed to fasten the deck boards 30 to the deck supports, and FIG. 2 shows the corresponding holes in the deck boards. FIG. 1 shows similar holes in the back supports 14 and 16, and FIG. 2 shows corresponding holes in the back boards 32 and 34. The holes in the deck and back supports are ½" in diameter and are centered 1¼" from the outside edge, i.e., the edge farthest from the center of the carrier. (Positioning the holes in this way instead of in the center of the support (1½" from edge) gives greater clearance for the bolts that fasten the boards to the supports.)

The holes for the deck boards 30 and the top back board 34 are ½" in diameter and positioned 1½" from each board edge, except that the backmost two holes in the back deck board are positioned 3" from the edge to allow for the placement of the bottom back board 32 on top of the back deck board, as shown in FIG. 1. The two lower back boards 32 contain three ½" holes for each board for each back support. The three holes are positioned 1½" from the bottom edge, 1½" from the top edge, and the third hole in the middle of the board, i.e., 5⅝" from each edge. The boards are fastened to the supports using ½×2½" carriage bolts inserted from above (deck boards) or the front (back boards), with nuts and lock washers.

The deck and back supports are positioned equidistance horizontally from the center of the back. In this embodiment, the inside edge of each support is 40" from the center of the deck or back, which results in an 80" wide deck area between the supports, and 17" of deck cantilevered beyond the supports at each end (and 3" of deck underneath each support). There is some flexibility as to what the distance can be, so that the supports might be closer to the yokes or closer to the ends of the deck.

Each deck side board 36 is fastened to the deck boards 30 using two lag screws with two flat washers per board, positioned 1½" from each edge (except that the back most screw is positioned 3" from the back edge). The screws are 5/16 inches by 3½" and are inserted from the bottom of the deck board up into the deck side board. The screw holes can be seen in FIGS. 1 and 5. Each back side board 38 is fastened to the back boards 32 and 34 using two lag screws with two flat washers per board. The screws for the two lower back boards 32 are positioned 1½" from each edge, and for the upper back board 34 are 1" from the edge. The screws are 5/16 inches by 3½". A seventh screw is inserted from the bottom of the back side board 38 into the back-most deck board 30. The screw holes can be seen in FIG. 6.

The back of the back-most deck board is screwed up into the bottom of the bottom-most back board using six 5/16 inches by 3½" lag screws with washers, as can be seen in FIG. 5

The grill 40 is fastened to the back using 30 1¼" staples. The grill overlaps the bottom of the top back board 34, the top of the top lower back board 32, and the two back side boards 38 by 1½-2".

While the rest of the front-end carrier is suitable in general for a very wide range of tractors and front-end loaders, the carrier's yoke will vary depending on the front-end loader to which the carrier is to be attached. In the simplest case, the loader will utilize a quick-attach mechanism, and therefore the yoke for the carrier will be a compatible quick-attach receiver, which can be acquired from the loader manufacturer and other sources.

If the loader does not have a quick-attach mechanism, then the yoke on the carrier should approximately match the yoke on the bucket attachment for the loader. That is what is used in this embodiment, in order to illustrate the detail that needs to be considered in this case. The yokes in this embodiment are designed for a specific brand and model of front-end loader (Bush Hog, Model M246). Of course, different design details would be used for different loaders.

The yokes 20 and 22 match the yokes on the bucket attachment for the front-end loader, in the following four measurements: (a) the distance between the sides, 3¾"; (b) the diameter of the holes, 1"; (c) the distance between the centers of the holes, 10"; (d) the angle between a line through the centers of the holes and a vertical line through the center of the upper hole, when the bottom of the bucket or carrier is horizontal.

Each yoke 20 and 22 is attached to the two lower back boards 32 using eight ½"×2½" hex head bolts with nuts and lock washers. The bolt holes for the left yoke 20 are shown in FIG. 7*b*, and the right yoke is a mirror image of the left. The bolts are inserted from the front side through a yoke plate 24 or 26, then through a lower back board, and then through a yoke. The yoke plate is used (in this embodiment) instead of eight flat washers on the front, in order to spread the stress on the back boards over a larger area. The 22½" length of the yoke permits it to extend over the full height of the two lower back boards 32. Thus, the downward force on the back of the carrier is borne by two 2"×12" boards instead of one. Furthermore, the shearing force on the back caused by weights toward the front of the deck is spread over two boards instead of one. These are the reasons why the back contains two 2"×12" boards at the bottom instead of just one.

The bolt holes are staggered from top to bottom as shown in FIGS. 7*b* and 2, with hole centers alternating between ⅝" to the left and ⅝" to the right of a line through the center of the yoke from top to bottom. The distance from the top of the yoke to the center of the top hole is 1½", and the other holes are successively 2¾" down, except that the third hole from the top is an additional 1⅛" down so as to provide clearance for inserting a pin through the side of the yoke when it is attached to the hydraulic system of the tractor's front-end loader.

The two yokes are positioned equidistance (horizontally) from the center of the back. The distance from the center of the yoke to the center of the back is determined simply to be the same as the corresponding distance for the bucket attachment that comes with the front-end loader, which in this embodiment is 37"/2=18½".

The two holes in each side of the yoke are 17/16 inches in diameter, so as to accept a pin or bolt with diameter 1 inch. The center of the bottom hole is 6" from the bottom of the yoke and 5⅛ from the front. The center of the top hole is 15¾ from the bottom of the yoke and 2⅜ from the front. The distance between the centers is 10". The reason for positioning the holes at different distances from the front is to duplicate the angle made by the bucket attachment for a front-end loader. (Unlike the front-end carrier, the back of a bucket is not perpendicular to the bottom of the bucket.) This gives the carrier the same range of tilt angles as the bucket, which is not mandatory but may be desirable. The yoke is connected to the front-end loader hydraulics using four 1"×5" hex-head bolts with nuts, lock washers, and two flat washers per bolt.

Operation of the Embodiment

As stated previously, this embodiment of the front-end carrier is an attachment for the front-end loader of a tractor, skid-steer device, or similar vehicle. The bucket attachment for the loader is removed, and the carrier is put in its place, using four pins or bolts through the holes in the sides of the yokes and through the holes in the hydraulic arms of the loader. The tractor operator uses the controls of the loader to raise and lower the carrier and to tilt the front of the carrier upward and downward.

The purpose of the deck side boards 36 and the back side boards 38 needs to be explained. The deck side boards serve to prevent the deck boards from warping, and they also help to reduce bending of the ends of the deck boards by requiring them to bend together. The back side boards perform a similar function for the back boards. Also, the back side boards provide a surface onto which the left and right sides of the grill can be fastened.

Imagine a 3-dimensional coordinate system described as follows: (a) the origin is at the back-most, lower-most, and left-most corner of the back-most deck board; (b) the positive x-axis runs from left to right along the lowest edge of the back-most deck board; (c) the positive y-axis runs from back to front along the lowest edge of the left end of the deck; (d) the positive z-axis runs from bottom to top along the back-most edge of the left end of the carrier back boards. Then (a) the deck boards, fastened together using the deck supports and bolts, give the carrier rigidity in the x-y plane; (b) the lower back boards, fastened together using the back supports and bolts, give the carrier rigidity in the x-z plane; and (c) the deck and back supports, fastened together using the L-braces and bolts, give the carrier rigidity in the y-z plane.

An embodiment very similar to the one described above has been constructed, used extensively, and tested. It has several advantages over the prior art, as follows:

(1) The deck of the carrier has a relatively large area for lifting and carrying materials and tools, or for using as a work surface. It has a relatively large capacity with respect to both volume and area. The embodiment is roughly 10 ft. wide, 4 ft. deep, and 4 ft. high, and thus has an area of about 40 square feet. This is about the same as the area of the bed of a full-size pickup truck with the tailgate up, which is about 8"×5"=40 square feet.

(2) For material that is stacked like brush or hay bales, the carrier has a relatively large volume. Multiplying width, depth, and height gives a rough volume measure of 160 cubic feet. However, the volume cannot be specified precisely as a single number, because it depends on how the material is stacked and how much it overlaps the carrier. For the brush application, the carrier can be tilted backward, with the deck and back forming a "V" shape that permits piling the material quite high without it falling off. Experimental results have shown that, for this purpose, the carrier has as much capacity as a full-size pickup truck with the tailgate down and stacked as high as possible.

(3) The carrier can carry many small objects lying on the deck, such as tools, lumber, nursery stock, roofing, bricks, fertilizer and seed bags, firewood, etc.

(4) The carrier can conveniently carry objects that are longer than the width of the aspect, such as pipes, logs, brush, lumber, etc.

(5) The carrier is made from inexpensive, off-the-shelf materials with inexpensive fabrication techniques. These materials are angle irons, steel bars and plates, treated boards, fencing material, bolts, nuts, washers, and screws. The fabrication techniques are: cutting the angle irons and bars to length, cutting the yoke plates to the right shape, welding the bars and plates to form the braces and yokes, punching holes in the steel, cutting the boards to length, positioning the boards and steel, drilling holes in the boards, and fastening the boards and steel together using the bolts, nuts, etc. Thus, the material and labor cost for manufacturing a carrier is relatively small.

(6) The carrier can be used as a scaffold, with a large area for standing, moving around, storing tools and material, etc. Again, the deck has roughly the same area as the bed of a full-size pickup truck.

(7) The treated boards used for the deck and back are very effective for this purpose because of their strength, stiffness, durability, cost, weight, and ease of assembly.

(8) The carrier can be marketed in a few different states of assembly, making shipping more economical. The most obvious state is in completely assembled form, probably at a tractor and implement dealership. A slight variation of this form would leave the yoke(s) unattached, so that yoke(s) customized to a front-end loader could be selected and positioned on the back of the carrier when it is bought. (The rest of the carrier, other than the yoke(s), is suitable for a wide range of tractor brands, models, and sizes, and does not need to be customized.) A second marketing form involves selling and shipping a "kit" consisting of the steel and fasteners, along with detailed assembly directions and a materials list for the wood and grill that the customer would purchase locally. Such material is commonly available, and the assembly could be done using ordinary tools and skills. The steel would already be cut to length, its holes would be punched, and it would be primed and painted. Having the customer purchase the wood and grill locally eliminates the shipping costs for those materials. The local assembly process merely requires cutting boards to length, drilling holes in wood, and fastening wood and steel using bolts and screws. A slight variation of this form would have the customer also buy the fasteners locally. A third marketing form involves shipping a completely assembled deck, a completely assembled back, and the braces and yoke(s). The customer would be required to bolt together the deck and the back, and to attach the yoke(s). An advantage of this form is that the deck and back are relatively flat and can therefore be shipped more cheaply than form one above. And the customer has less assembly to do than with form two above.

(9) Using this implement on a tractor's front-end loader, for carrying various objects, has many advantages over a pickup truck and a trailer, as described in the Summary Section, outlined above.

(10) For materials such as brush, the operation of unloading requires virtually no manual effort, thus providing a major advantage over trucks and trailers for brush collection.

(11) The carrier can be raised high to facilitate unloading material onto a high surface such as a second floor under construction, a barn loft, or a roof.

(12) The carrier has several possible miscellaneous applications, including a work bench, a seat, a picnic table, a water tank transporter, and a rain shelter (with a tarp).

Additional Enhancements

Here we describe six useful accessories that can be conveniently attached to the first embodiment. They are illustrated in FIGS. 11-15. All of these components have been constructed and used extensively.

(1) Guard rail. A removable guard rail along the front of the deck is desirable for applications in which the carrier is being used as a scaffold. The rail consists of a 2"×4"×10' rail board 70. It is supported at each front corner by a 2"×4"×36" rail post 72, which is supported by a flange 74 made of a 5"×5"×3/16" steel plate and a 4" length of 3/16" steel tube welded to the plate. The flange is fastened to the deck using four 5/16"×2½" hex head bolts, nuts, flat washers, and lock washers. The post is held in place in the flange by a 5/16"×2½" hex-head bolt with nut and lock washer. Each end of the rail is fastened to the top of the post using a 5/16" square lock pin through two 3¾" eye screws. When the posts are removed, the flanges are filled with 2"×4"×5" stubs to keep out debris. Alternatively, if the railing will not be needed for a long period of time, then the user may prefer to remove the two flanges.

As an alternative, it would be possible to have a rail system using nylon rope and clips instead of the 10-foot 2 by 4, with the rope going around the sides as well as the front.

(2) Deck stiffener. The deck stiffener 80 consists of a 10' (or 9' or two 5') steel flat iron, ¼"×3". (The 10 foot length is preferable, but for some marketing models there might be a shipping length restriction of 9 feet.) This stiffener is fastened to the edge of the front board using ten ⅜" lag screws.

(3) Tool box. The tool box 82 is designed to hold a small chain saw, a water jug, and other small items. The box is 26 inches long, 11½ inches wide, and 8 inches deep. It is made of 1"×8" boards nailed together and fastened to the left end of the back. There is a small block 84 with a hole in the middle, fastened to one corner of the tool box, for storing a chain saw wrench.

Figure 13:
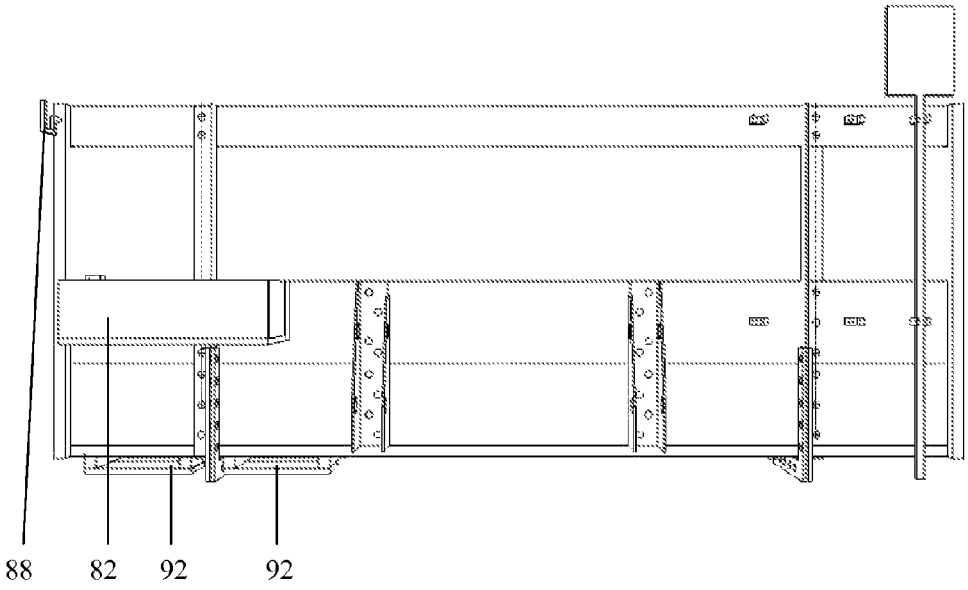
Figure 14:
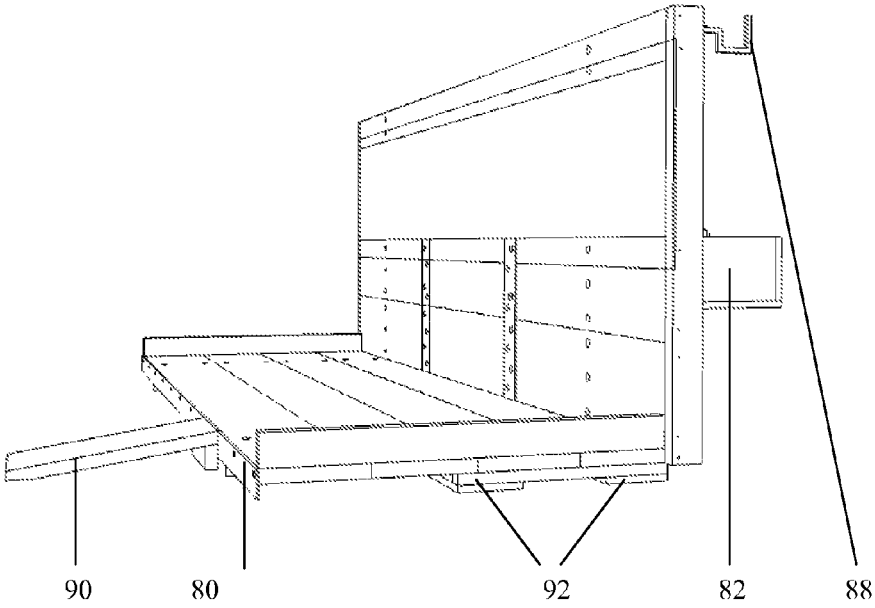
Figure 15:
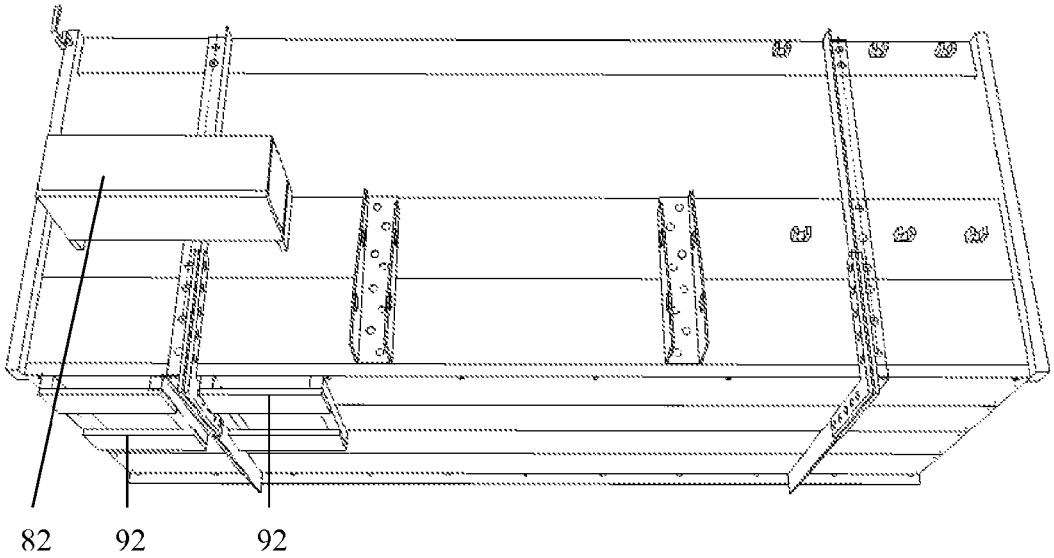

(4) Tool hangers. Another set of components consists of six large spring tool hangers 86, three of them fastened to the right side of the top back board and three fastened directly below them to the middle back board. These hanger pairs are used for carrying long-handle tools such as a shovel, rake, pitch fork, etc. (The diagram of a shovel in FIG. 13 is intended to illustrate the use of a pair of hangers and is not a component of the carrier.)

(5) Ear muff hook. There is also a hook hanger 88 near the upper left corner of the back, for hanging ear muffs.

(6) Ramps and ramp storage compartment. A final accessory consists of two ramps 90, along with a ramp storage compartment 92, intended for rolling objects onto the front of the deck, such as heavy logs, wheel barrows, lawn mowers, etc. The ramps are made of 2"×12"×2' boards, with a leg at one end made from a 2"×12"×3" board. Both ends of the 2"×12" and the top edge of the leg are bevel-cut to an appropriate angle (about 7 degrees) to make a smooth ramp from the ground to the top surface of the deck. The storage compartment consists in part of three 2"×2"×2' boards fastened in parallel to the underside of the left side of the deck. The boards are placed 11½" apart. The thickness of the boards is 1⅝", or ⅛ inch greater than the thickness of the ramp. Two 1"×8"×27½" boards are nailed onto the 2"×2" boards, creating two sleeves into which the two ramps can be slid (with the legs up). The ramps are then held in place by drilling a ¼" hole through the top of the deck and through each ramp (in its stored position), and then inserting a 3 inch common nail.

Alternative Embodiments Considered

Eight alternative designs and embodiments of the designs were created and evaluated during the development of the first embodiment (or preferred embodiment, abbreviated PE). Most of the designs have been rejected and are not compatible with the claims. Here we discuss five of the designs, indicating whether they have been rejected or they are acceptable variations of the PE that are compatible with the claims. The other designs are discussed in the section Conclusion, Ramifications, and Scope.

Figure 9A:
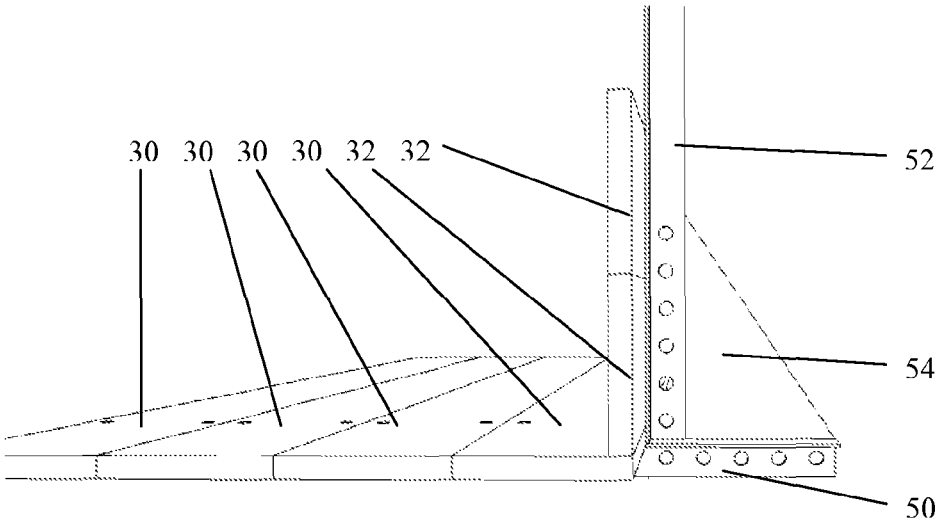
FIGS. 9*a*-9*e* are views from different positions of a gusset, a deck support, and a back support fastened together

One (rejected) alternative design for the front-end carrier consisted of extending each deck support a short distance (e.g., 15") behind the back, and then bolting or welding a triangular steel plate (gusset) to this extension of the deck support and to the bottom of the back support. An embodiment of this alternative is illustrated in FIG. 9*a*, which shows the deck boards 30, lower back boards 32, left deck support 50, left back support 52, and gusset 54. The gusset holds the deck and back supports rigidly at a 90-degree angle. FIGS. 9*b*-9*e* show the left deck support, the left back support, and a gusset from the following four viewpoints, respectively: from behind and to the right, close-up from behind and to the right, from the right, and from behind and to the left.

The gusset is made from a 5/16 inch steel plate. Its bottom edge has a length of 15" and its front edge has a length of 21". The back edge and top edge have a length of 3". There are five 9/16 inch holes positioned 1½" above the bottom edge, and six 9/16 inch holes positioned 1½" behind the front edge. The bottom holes are at distances 1½", 4½", 7½", 10½", and 13½" from the front (and back) edge. The front holes are at distances 1½", 4½", 7½", 10½, 13½", and 16½" from the bottom (and top) edge.

The deck support has five 9/16 inch holes in the same positions, starting from the back, as in the bottom edge of the gusset. The back support has six 9/16 inch holes in the same positions, starting from the bottom, as in the front edge of the gusset. The supports and gusset are bolted together using 11½"×1½" hex head bolts, 11 nuts, 22 flat washers, and 11 lock washers.

There is ample clearance behind the carrier so that neither the front of the tractor nor the ground interferes with the motion of the gusset. Disaadvantages of the gusset are discussed herein below.

Figure 10A:
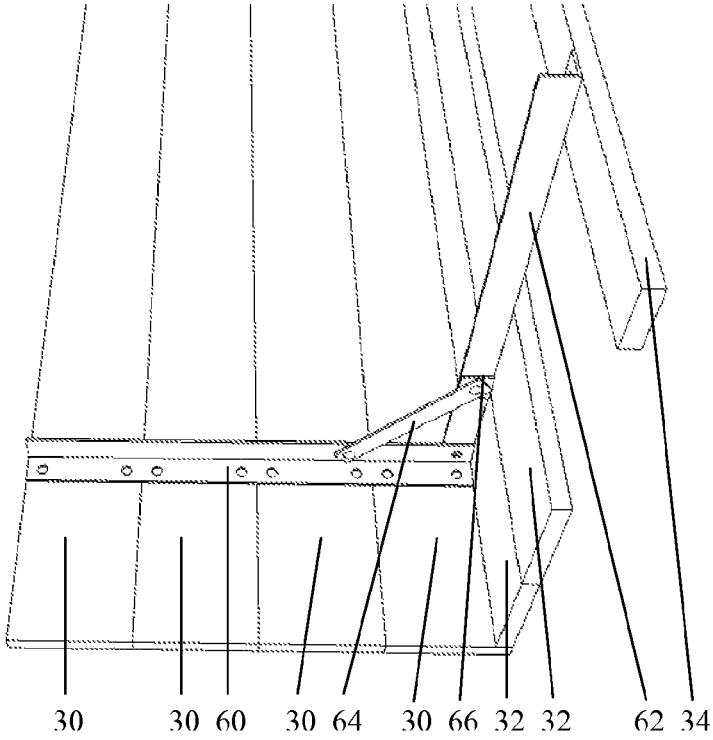
FIGS. 10*a* and 10*b* show an alternative embodiment in which the deck boards are fastened underneath the deck supports, the back boards are fastened on the back side of the back supports, and the braces are straight steel bars instead of being L-shaped.
Figure 10B:
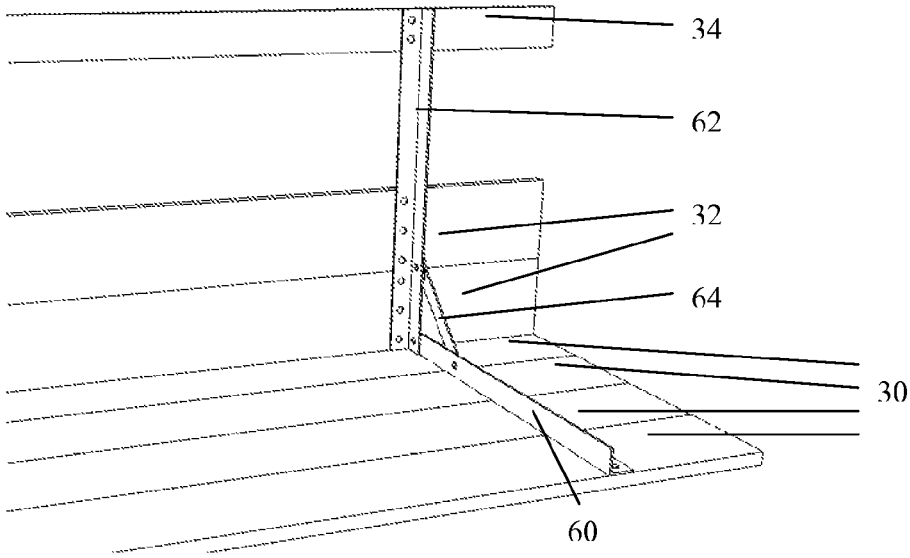
Figure 11:
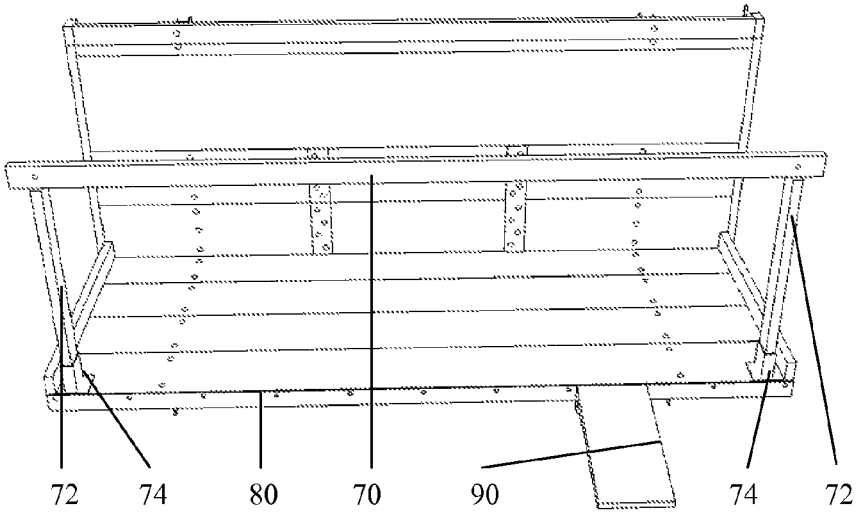
FIGS. 11-15 illustrate several accessories that can be attached to the carrier.
Figure 12:
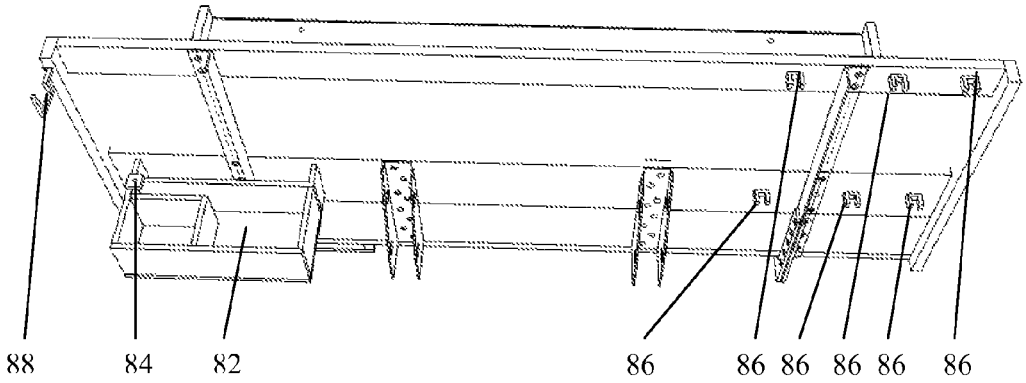

A second (rejected) alternative design for the front-end carrier involved positioning the deck boards below the deck supports and the back boards behind the back supports. Also, this design used a straight brace instead of an L-brace to hold the deck and back supports rigidly at a 90-degree angle. FIG. 10*a* is a perspective view of the left side of an embodiment of this design, from above and to the left, and FIG. 10*b* is a perspective view of the left side of the embodiment from above and in front. The figures show the deck boards 30, the lower back boards 32, the top back board 34, the left deck support 60, the left back support 62, and the straight brace 64. A spacer 66 is barely visible in FIG. 10*a* and is not visible in FIG. 10*b*.

The deck support has ½" holes in its side, centered 1½" and 12" from the back. The back support has ½" holes in its side, centered 1½" and 12" from the bottom. The brace is ¼" thick, 2" wide, and 17" long. It has ½" holes slightly more than 1" from each end, so that the holes are 14.85" apart. The spacer is ¼"×3"×3", and it has a ½" hole in its center. The deck support and back support are fastened together at their ends by inserting a ½"×1½" hex head bolt through the bottom hole in the back support and the back hole in the deck support, and securing with a nut and lock washer. Similarly, each end of the brace is fastened to either the deck support or the back support by inserting a ½"×1½" hex head bolt through the other hole in the side of the support and the hole near the end of the brace. The spacer is positioned between the back support and the upper end of the brace to make the brace lie in the same plane as the side of the deck support. Note that the square of the distance between the holes in the brace equals the sum of the squares of the distances between the holes in the deck support and between the holes in the back support, so that the brace holds the deck support and back support at a 90-degree angle.

The deck boards and back boards are fastened to the deck supports and back supports using ½"×2½" hex head bolts inserted through the supports and then the boards, and secured with a flat washer, lock washer and nut.

This alternative design is actually intended to illustrate two alternatives: first, an implement in which the deck supports and back supports are on the interior of the carrier, and second, an implement using straight braces instead of L-braces or a gusset. It would be possible to use L-braces instead of the straight braces. The advantage of placing the deck boards underneath the deck supports is that the deck surface can be lowered to within 1½" of the ground, making it easier to roll objects onto the surface. One disadvantage is that the deck and back surfaces have obstructions in the form of the supports. Another disadvantage is that the straight braces, if they are used instead of L-braces, constitute even bigger obstructions for many applications.

A third (accepted) alternative embodiment of the front-end carrier is to use five 2"×10"×10" boards for the deck, instead of four 2"×12"×10' boards. These boards have a width of 9¼", so five boards would form a deck with a depth of about 46¼". Thus the deck supports would need to be 46¼" long instead of 45". The bolt holes would still be positioned 1½" from each board edge, and now there would be ten holes in each deck support instead of eight. Also, the deck side boards would be 44¾" in length instead of 43½" and ten lag screws would be needed to fasten each deck side board to the deck boards.

A fourth (accepted) alternative embodiment of the front-end carrier is to use a double sheet of ¾" plywood, instead of boards, for the deck. The deck thickness would still be 1½", the depth would be 48", and the width could be 8' or 10' depending on the length of the plywood. A variation on this alternative would be to use a suitably thick sheet of fiberglass instead of plywood.

A fifth (rejected) alternative design involved constructing a deck and back from boards or sheets, bolting or otherwise fastening the deck to the horizontal segment of the forks of a fork lift attachment, and bolting or otherwise fastening the back to the vertical segment of the forks. While this design might provide a reasonable solution for a user who already has a fork lift attachment, it would be far more expensive than the front-end carrier design if the user does not already own a fork lift attachment and has to purchase one.

The major difference between the two designs is that the front-end carrier employs steel angle irons and L-braces to support the deck and back, while this alternative design employs steel forks. The angle irons and L-braces are extremely efficient in providing excellent strength and rigidity for their size and cost. For example, the volume of a deck support and one leg of each of two L-braces in the PE is (3"+3")×¼"×45"+2×(2½"×½"×18")=112.5 cubic inches. By comparison, a typical size of a fork on a fork lift (the equivalent support component on the alternative design) is 4" wide and 1½" thick at the bend. If the horizontal segment of a fork is 45" long (and not tapered), then its volume would be 270 cubic inches, which is well over twice as much steel as required for the corresponding support components on the PE. (Of course, different dimensions could be used for the fork, angle iron, and/or L-brace, but the general comparison would be similar.) Besides the lame difference in material cost and weight, the labor cost for drilling or punching the holes in ¼" angle iron, for fastening to the deck boards and back boards of the front-end carrier, is very much less than would be the labor cost for drilling holes in 1½" thick steel forks.

Thus it can be seen that the front-end carrier attachment permits multiple embodiments that provide several advantages over existing attachments for front-end loaders, as well as advantages over trucks, trailers, fork lifts, and some other equipment, for several applications. First, the attachment has a very large capacity, with respect to both volume and area, as compared to other front-end loader attachments. Second, the attachment can conveniently carry both small objects and very long objects, including objects that are longer than the width of the attachment. Third, for materials such as brush, the operation of unloading requires virtually no manual effort, thus providing a major advantage over pickup trucks and trailers for the collection of brush or comparable materials. Fourth, the attachment can be lowered to within a few inches of the ground, thus facilitating the loading of objects, especially heavy objects. Fifth, the attachment can be raised to the level of a trailer or truck bed to ease the movement of certain heavy objects onto or off of the bed. Sixth, a tractor using the attachment is much more maneuverable than a truck and especially a trailer, enabling the operator to get very close to the material to be loaded. Seventh, the attachment can be used as a scaffold, with a large area for standing, moving around, storing tools and material, etc. Eighth, the attachment can be made largely from inexpensive, off-the-shelf materials with inexpensive fabrication techniques. Ninth, the attachment can be marketed in a few different states of assembly, including kit form, making shipping more economical. These and other advantages of one or more embodiments of the carrier make it superior to other available devices for many applications.

There are many possible variations on some of the specific details of the first embodiment, additional enhancements, and alternative embodiments described herein. Following are some examples: The following measurements can be increased or decreased: the width, depth, and height of the carrier; the width of the deck boards and back boards; the thickness, width, and length of the steel supports; the thickness, width, and length of the L-braces; the dimensions of the deck side boards and back side boards; the dimensions of the tool box. Different materials can be used for the deck and back surfaces and for the grill in the back. The back surface can be solid instead of having a space covered by a grill or strips. The number of deck supports and back supports can be greater than two, and the positioning of the supports between the left and right sides of the carrier can be varied. The yoke can consist of a quick-attach receiver, or it can be varied in shape and size so as to fit the front-end loader to which the carrier is to be attached. The yoke(s) can be attached to the back of the carrier using flat washers in place of a yoke plate.

The scope of the attachment should be determined by the included claims and their legal equivalents, rather than by the embodiments given.

We conclude with several comments about earlier designs, problems encountered, and improvements made during development of the preferred embodiment. Several design features for the front-end carrier were considered, implemented, and evaluated during the process of developing the ideal design, described in the first embodiment. This first embodiment (or preferred embodiment, abbreviated PE) is a composite of the best of these features, optimizing utility, efficiency, and cost. Following is a list of features that the PE improves upon, and problems that the PE has solved:

Wooden supports
Channel iron supports
Carrier attached to bucket
Supports on inside of carrier
Gussets
Straight steel braces
Yoke and hole positioning Stress on the back boards
Hydraulic hose cutout
Warping and sagging
Welding braces to supports The first prototype built used two 2"×8"×4' treated boards to support the deck. The deck boards were screwed into the bottom of these supports. This had the advantage of putting the deck right on the ground, for ease of rolling logs, wheelbarrows, etc., onto the deck. It had the disadvantage of a deck surface that was not flat, but was rather interrupted by these two boards sticking up more than 7 inches. The deck boards could have been fastened on top of the supports, but that would have made it much more difficult to roll objects onto the deck. In either case, it seemed that an all-wooden attachment would not be an attractive device to market successfully. Clearly, the PE has eliminated all of these problems by using steel supports, providing a very flat, smooth deck (and back), and raising the bottom of the deck only 3" from the ground, making it still quite convenient for rolling on objects using the ramp accessory.

The second prototype built used channel iron supports for the deck and back, rather than angle irons. A disadvantage of this design is that channel irons are typically much wider than they are high. For example, a 3" wide channel iron might have sides that are only 1.4" or 1.5". Two 1.5" sides in a horizontal channel iron do not have as much strength in the vertical dimension as one 3" side in a horizontal angle iron. In order to match the strength in the vertical dimension of a 3"×3" angle iron, it would be necessary to use a typical channel iron that is much wider than 3", which is much wider than otherwise necessary. This is the reason that the PE uses angle irons instead of channel irons for the supports.

Two prototypes were built, that attached to the bucket of the front-end loader, rather than attaching directly to the hydraulic arms after removing the bucket. One prototype used two 2"×8"×4' treated boards as supports, and was discussed above. The other prototype used two angle iron supports. In both devices, the supports were fastened to the side of the bucket using two bolts passing through each support and through holes drilled in the bucket. Also in both devices, the deck boards were screwed or bolted into the bottom of the supports. Also in both devices, there were two 2"×12"×10' boards in front of the bucket and two 2"×12"×3" boards on each side of the (5') bucket, with one end of each board fastened to the support on that side of the bucket, and the other end supported by the back and by the two 10' boards in front of the bucket. This design had the advantage of using the strength and rigidity of the bucket to support the deck and back of the carrier, instead of using L-braces, gussets, etc. It also eliminated the need to provide yokes with the carrier. Finally, it had an advantage (if the loader did not use the quick-attach connection) in that the user could save time when attaching the carrier by not having to remove the bucket.

An obvious major disadvantage of this design was that the sides of the bucket got in the way of carrying material. It was still possible to carry long objects (e.g., branches, logs, pipes, power pruners) on the boards in front of the bucket, but the carrier was less effective for this purpose.

A second disadvantage was that the side of a bucket is usually not flat, instead having a lateral protrusion (possibly around ¾") near the front lip, as a reinforcement. This protrusion required (a) positioning the supports above the protrusion (a few inches above the bottom of the bucket), (b) cutting out wood in the proper place, for wooden supports, or (c) using a spacer (e.g., ¾" thick) around each hole, for steel supports. Positioning the supports above the bottom of the bucket was undesirable because then the deck boards would also be positioned a few inches above the bottom of the bucket, producing an uneven deck surface and also allowing debris to collect at the juncture of these two surfaces. One problem with using spacers is that bolting a deck support to the side of the bucket with a (¾") spacer in between produced a weaker joint than bolting the support directly to the bucket side. Moreover, the spacers were somewhat difficult to hold in position when inserting bolts. Another serious disadvantage of the design using steel supports was that it required the supports to be positioned very precisely so as to fit snugly around the bucket, making it quite difficult for the user to drive the tractor with the bucket in between the supports when fastening the carrier. A final disadvantage of this design was that it required the user to drill holes in his bucket, which would be fairly difficult, and which some potential users would be reluctant to do.

The PE is a definite improvement over the design of attaching the carrier to the bucket. Obviously, the PE provides a smooth, flat deck and back, with no bucket sides or top to interfere with loading of material. Moreover, the process of attaching and detaching the PE to the tractor is much easier (especially using a quick-attach connection), being somewhat similar to attaching an implement to the three-point hitch at the back of the tractor.

Another prototype was built using angle iron supports on the inside of the carrier (cf. FIGS. 10*a*-10*b*), i.e., with the deck boards on the bottom side of the deck supports and with back boards on the back side of the back supports, i.e., on the side next to the tractor. The boards were fastened to the supports using hex-head bolts. The advantage, as with the wooden supports, was the ability to get the deck boards right down to the ground, but the disadvantage was that the smoothness and flatness of the deck (and back) surface was interrupted by the angle iron supports and the bolt heads. The PE eliminates this problem by providing a very smooth and flat deck and back. We note that by positioning the deck and back supports on the outside of the carrier, it becomes possible to use carriage bolts through the deck and back boards to fasten these boards to the supports, making an even smoother surface than if hex-head bolts were used.

Two prototypes used a different type of bracing, which was a straight steel brace from the back support to the deck support to hold the two supports rigidly at a 90 degree angle. This bracing was described herein above and is illustrated in FIGS. 10*a*-10*b*. Its advantage is its simplicity and efficiency. A major disadvantage is that the braces encroach on the storage space of the carrier, like the sides of a bucket. A second disadvantage is that it requires either that the supports be on the inside of the carrier, or that slots be cut in the deck and back boards so that the braces can be attached to supports on the outside of the carrier. Even using the option having the supports on the outside, the PE is a better design because it provides a clear storage space.

Figure 9B:
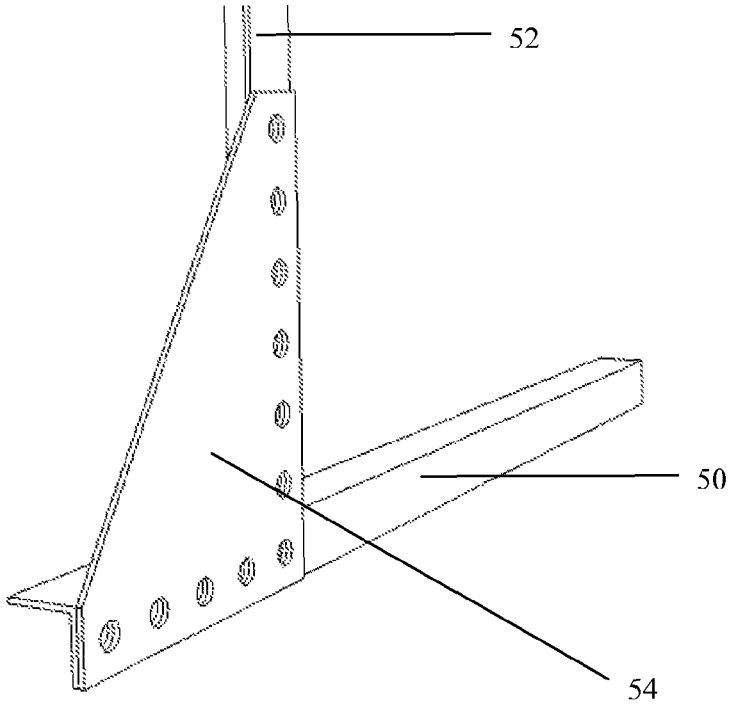
Figure 9C:
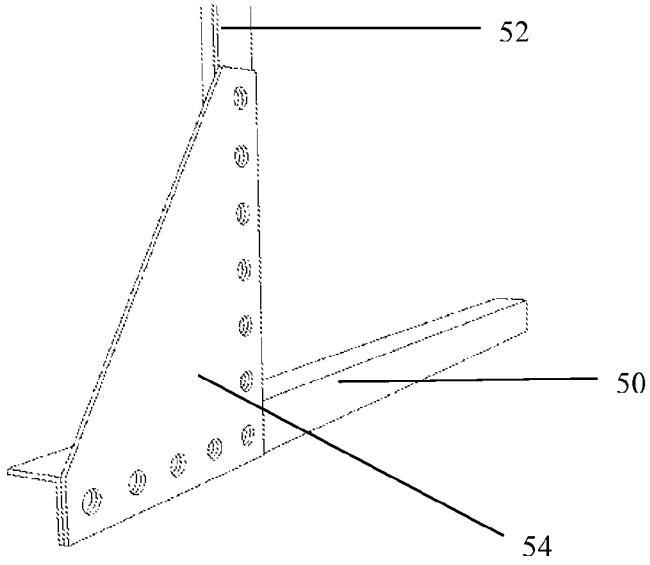
Figure 9D:
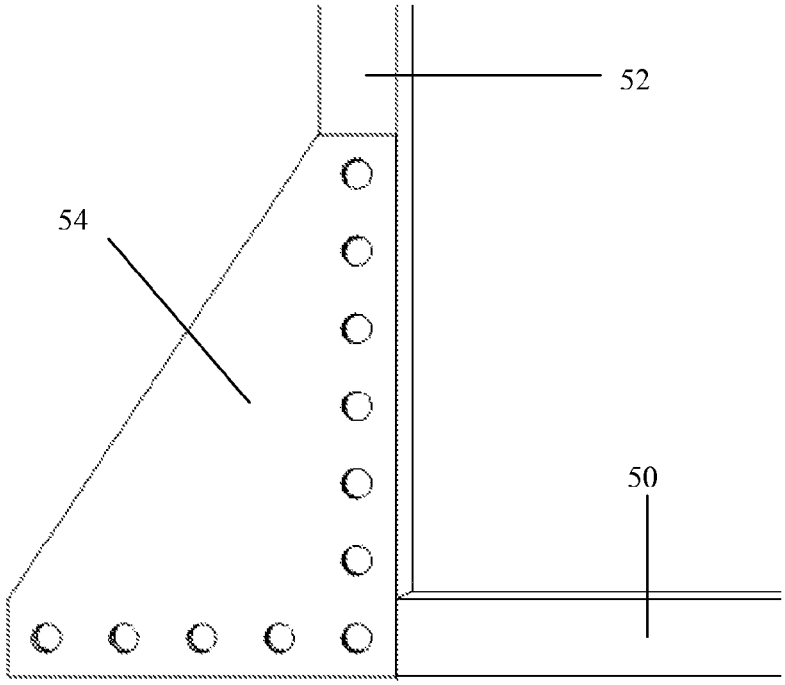
Figure 9E:
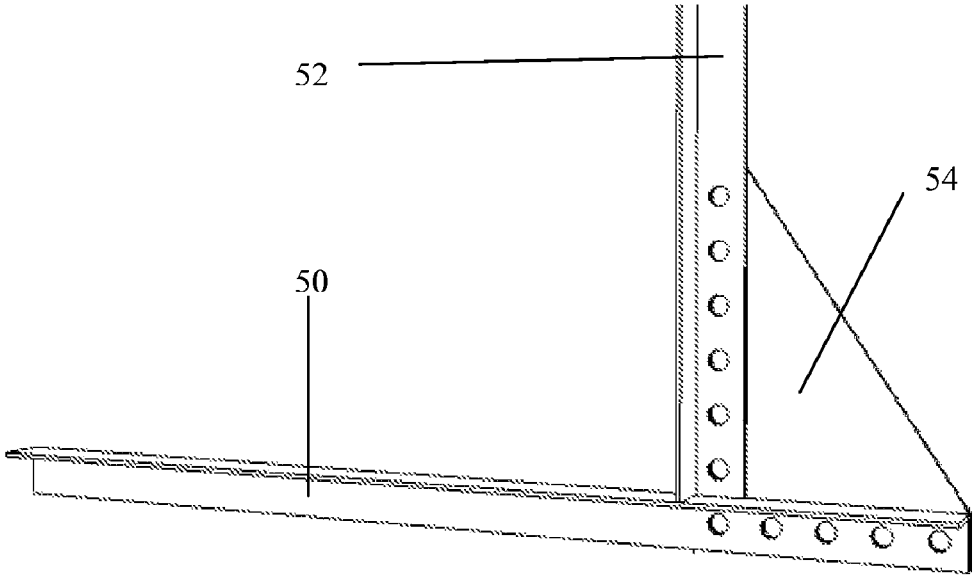

Yet another type of bracing used was a gusset, shown in FIGS. 9*a*-9*c* and described earlier. A disadvantage of this design was that the part of the deck support that extends beyond the gusset is the part that is in front of the back of the carrier, which has a length of about 45 inches. By comparison, the L-brace used in the PE (FIGS. 1, 3, 4*a*-4*c*) extends forward from the back of the carrier for about 18 inches, so that the part of the deck support that extends beyond the brace has a length of only about 45"−18"=27". Thus the L-brace produces a joint between the back supports and deck supports that is stronger and more rigid than that produced by the gusset. Also, the L-brace is much more compact, and it does not require that the deck supports be extended backwards.

Finally, its fabrication is much easier and cheaper, largely because it requires much less cutting and uses less material.

We wish to emphasize at this point that the use of the L-braces and angle irons, on the outside of the carrier, contributes very significant benefits to the design of the carrier. First, it creates an open, smooth cargo space bordered by the deck and back, by positioning the bracing on the outside of the deck and back instead of on the inside. Second, it adds almost nothing to the exterior volume of the carrier, since the braces fit snugly against the angle irons with no extension of the angle irons. Third, the angle irons and L-braces are extremely efficient in providing excellent strength and rigidity from a minimal amount of steel, having a minimal cost. Fourth, the brace design is highly amenable to being fastened to the deck and back supports by bolting rather than welding, thus making it possible to ship the components in disassembled form, thus reducing the cost of shipping and also facilitating the marketing of the implement in kit form.

In general, the front-end carrier produces a highly efficient, cost-effective, carefully engineered, and non-obvious design for an implement with a wide range of important applications.

Another concern in designing the carrier was the stress on the lower back boards caused by loads on the deck, especially weights near the front of the deck. Such weights push downward on the deck supports, which in turn (assuming a rigid brace fastening together the deck and back supports) creates a twisting force or torque on the back boards in a counterclockwise direction when viewed from the left of the carrier. This force is translated to the yokes. With the yokes holding the back boards firmly in place, the portion of lower back boards between the left and right back supports must support this twisting force. The PE incorporates three special features in order to deal with this stress. First, its yokes are long enough or almost long enough to cover the entire width of the two lower back boards, which is 22½", thus spreading the twisting stress over the entire width of both boards (cf. FIG. 1). Second, the distance between the yoke and the associated back support is kept fairly small (40"−18½"=21½ inches in this embodiment), which reduces the length of the segments of the lower back boards that are subjected to this stress, compared to what the length would be if the back support were farther from the yoke. Third, a yoke plate is used instead of flat washers on the front side of the lower back boards, in order to further spread out the stress on the back boards caused by the heads of the bolts that fasten the yokes to the boards (cf. FIGS. 8*a*-8*b*).

We comment that the distance between the left (right) yoke and the left (right) back support is an important parameter. Making this distance positive (i.e., not positioning the yoke and back support together) is an important feature of the front-end carrier design. It takes advantage of the ability of the lower back boards to withstand the stress due to twisting, in order to make it possible to have a wider deck without excessive sagging on the sides of the deck. Increasing the distance has the advantage (for a given deck width) of reducing that portion of the deck that is cantilevered beyond the deck supports, and hence has the advantage of reducing the sag on the front part of the deck. Increasing this distance has the disadvantage of increasing the length of back boards that must bear the twisting stress described in the previous paragraph. Taking into account the strength of the boards or sheets used in the deck and back, there is a range of distances that will produce an implement with sufficient strength for many applications, and it is important to use a distance within this range. As noted, the PE uses a distance of 21½ inches, and tests have shown it to have ample strength with regard to the lifting capacity of many front-end loaders.

There was a lesser concern about the straight downward force on the two lower back boards caused by weight on the deck, including weight near the back of the deck. These boards easily have enough strength in the vertical dimension to support more weight than the tractor and front-end loader can lift, but it was important to also consider stress on the bolts fastening the yokes to the back boards as well as stress on the region of wood that was supporting these bolts. To address this problem, the PE uses eight ½" bolts for each yoke, and the bolt holes are staggered in two vertical columns down the two boards (cf. FIG. 7*b*). One of the bolt holes is lowered about 1¼" to provide clearance for inserting the pin through the upper holes in the side of the yoke.

In making yokes for the PE that spanned the entire width of the two lower back boards, the top of the side of each yoke nearer to the middle of the carrier could contact the hydraulic hose attached to the hydraulic arm when the carrier is tilted all the way back. To remedy this problem in the PE, the top two inches of this side are cut out (cf. FIG. 7*a*).

Two problems encountered while building prototypes involved warping and sagging of boards. Both the deck boards and the back boards tended to warp, making the edges of the deck and back uneven. The PE uses deck side boards and back side boards, screwed onto the ends of the deck boards and back boards, to eliminate this problem (FIGS. 1-2). The problem of sagging affected both the front and back edges of the deck. In the PE, the back edge of the back deck board is screwed into the bottom edge of the bottom back board, entirely eliminating the problem at the back edge. It was not possible to completely eliminate sagging at the front edge, but the problem is reduced in the PE by screwing a flat steel deck stiffener into the front edge (cf. FIGS. 11, 14, 15). The deck side boards also reduce sagging at the deck ends because each board end is supported by its neighboring board (s).

When using an L-brace to fasten together a deck support and a back support, the components can be fastened using either bolts or welds. While welding is strong and not expensive, it has a major disadvantage in that it produces a single, rigid, bulky, and heavy component that is difficult to ship. Since one possible marketing scheme would involve shipping the steel components to individual customers, the PE uses bolting rather than welding for fastening these components, so that the components can be shipped more economically. Of course the holes in the steel would be made during the manufacturing process. The steel used in the PE for the braces and angle irons has a maximum thickness of ½", and therefore the holes can be made by punching rather than drilling, punching being a faster and less expensive process.

I claim:

1. An attachment for a front-end loader for a tractor or similar vehicle, comprising:

a deck, normally positioned horizontally, comprising an approximately flat, rigid, solid, rectangular surface comprising equal-length boards or sheets made from wood or a synthetic material, and two or more angle iron or channel iron supports positioned across an entire width of said boards or sheets and bolted to said boards or sheets and capable of rigidly holding said boards or sheets in place and supporting said surface;

a back, normally positioned vertically, comprising an approximately flat, rigid, rectangular surface having three rectangular regions: a bottom region, a middle region, and a top region; with the bottom and top regions comprising boards or sheets made from wood or a synthetic material, and the middle region comprising a grill or mesh or strips fastened to the top of said bottom region and to the bottom of said top region; and an equal number of angle iron or channel iron supports as used for the deck, with said supports positioned vertically across the combined height of said bottom, middle, and top regions and bolted to said boards or sheets of said bottom and top regions, and capable of rigidly holding said boards or sheets in place and supporting said surface, wherein the length of said boards or sheets is the same as the length of said boards or sheets in said deck, and wherein the spacing of the said supports across said back is the same as the spacing of the said deck supports across said deck;

one or two steel braces for each deck support, each said brace shaped like a flat corner iron comprising two approximately perpendicular legs, with one leg of each said brace fastened by bolting or welding or riveting to one side of the back end of one deck support, and the other leg of said brace fastened by bolting or welding or riveting to the corresponding side of the bottom end of the back support at the same lateral spacing as said deck support, so as to rigidly hold the back of the attachment at the back edge of the deck at approximately a 90 degree angle; and a pair of brackets, attached to the back side of the bottom region of said back, and designed for connecting the attachment to said front-end loader, wherein the brackets can be connected to hydraulic arms of said front-end loader so that the said loader is able to lift, lower, and tilt said attachment, whereby objects or materials can be loaded onto said attachment and then lifted, tilted, carried, and dumped by the tractor operator.

2. An attachment for a front-end loader for a tractor or similar vehicle, comprising:

a deck, normally positioned horizontally, comprising an approximately flat, rigid, solid, rectangular surface comprising equal-length boards or sheets made from wood or a synthetic material, and two or more angle iron or channel iron supports positioned across the entire width of said boards or sheets and bolted to said boards or sheets and capable of rigidly holding said boards or sheets in place and supporting said surface;

a back, normally positioned vertically, comprising an approximately flat, rigid, rectangular surface having two rectangular regions: a bottom region and a top region; with the bottom and top regions comprising boards or sheets made from wood or a synthetic material; and an equal number of angle iron or channel iron supports as used for the deck, with said supports positioned vertically across the combined height of said bottom and top regions and bolted to said boards or sheets of said bottom and top regions, and capable of rigidly holding said boards or sheets in place and supporting said surface, wherein the length of said boards or sheets is the same as the length of said boards or sheets in said deck, and wherein the spacing of the said supports across said back is the same as the spacing of the said deck supports across said deck;

one or two steel braces for each deck support, each said brace shaped like a flat corner iron comprising two approximately perpendicular legs, with one leg of each said brace fastened by bolting or welding or riveting to one side of the back end of one deck support, and the other leg of said brace fastened by bolting or welding or riveting to the corresponding side of the bottom end of the back support at the same lateral spacing as said deck support, so as to rigidly hold the back of the attachment at the back edge of the deck at approximately a 90 degree angle; and a pair of brackets, attached to the back side of the bottom region of said back, and designed for connecting the attachment to said front-end loader, wherein brackets can be connected to hydraulic arms of said front-end loader so that the said loader is able to lift, lower, and tilt said attachment, whereby objects or materials can be loaded onto said attachment and then lifted, tilted, carried, and dumped by the tractor operator.

3. The attachment of claim 1 or 2, further including a board fastened to each end of said deck.

4. The attachment of claim 1 or 2, further including a board fastened to each end of said back.

5. The attachment of claim 1 or 2, further including a board fastened to each end of said deck and said back.

6. The attachment of claim 1 or 2, further including means for a safety rail to protect against a person falling off of said deck.

7. The attachment of claim 1 or 2, further including means for a box fastened to said back for carrying tools.

* * * * *

UNITED STATES PATENT AND TRADEMARK OFFICE

CERTIFICATE OF CORRECTION

PATENT NO. : 8,333,263 B1
APPLICATION NO. : 12/853355
DATED : December 18, 2012
INVENTOR(S) : William Edward Wright It is certified that error appears in the above-identified patent and that said Letters Patent is hereby corrected as shown below:

In Column 1, Line 62, delete “most” and insert --cost--, therefor.

In Column 3, Line 52, insert --(-- before the word “alternative”.

In Column 4, Line 41, “43 1/4” should read --43 1/2--.

In Column 5, Line 63, a period should appear after “FIG. 5”.

In Column 6, Line 59, “5 1/8” should read --5 1/8"--; “15 3/4” should read --15 3/4"--; and in Line 60, “2 3/8” should read --2 3/8"--.

In Column 7, Line 3, the words “Operation of the Embodiment” should be centered and have line spaces above and below the wording; and in Line 44, “8" × 5'"” should read --8' × 5'--

In Column 8, Line 59, the words “Additional Enhancements” should be centered and have line spaces above and below the wording.

In Column 9, Line 23, superscript “11/1/2” should read --11 1/2--.

In Column 10, Line 28, “111/2” should read --11 1/2--; and in Line 32, delete “Disaadvantages” and insert --Disadvantages--, therefor.

In Column 11, Line 19, “2"×10"×10'"” should read --2"×10"×10'--; in Line 60, delete “lame” and insert --large--, therefor; and between Lines 65 and 66 insert the heading --Conclusion, Ramifications, and Scope--.

In Column 13, insert a blank line between lines 4 and 5.

Signed and Sealed this
Twenty-sixth Day of February, 2013

Teresa Stanek Rea
*Acting Director of the United States Patent and Trademark Office*